US005824630A

United States Patent [19]

Christie et al.

[11] Patent Number: 5,824,630

[45] **Date of Patent: *Oct. 20, 1998**

[54] MACHINE DISHWASHING COMPOSITION CONTAINING OXYGEN BLEACH AND PARAFFIN OIL AND NITROGEN COMPOUND SILVER TARNISHING INHIBITORS

[75] Inventors: Julie Ann Christie, West Jesmond; Fiona Susan MacBeath, Gosforth; John Christopher Turner, Ponteland, all of Great Britain

[73] Assignee: The Procter & Gamble Company

[ * ] Notice: This patent issued on a continued prosecution application filed under 37 CFR 1.53(d), and is subject to the twenty year patent term provisions of 35 U.S.C. 154(a)(2).

[ * ] Notice: The term of this patent shall not extend beyond the expiration date of Pat. No. 5,599,781.

[21] Appl. No.: 583,105

[22] PCT Filed: Jun. 17, 1994

[86] PCT No.: PCT/US94/06879

§ 371 Date: Mar. 19, 1996

§ 102(e) Date: Mar. 19, 1996

[87] PCT Pub. No.: WO95/02680

PCT Pub. Date: Jan. 26, 1995

[30] Foreign Application Priority Data

Jul. 16, 1993 [EP] European Pat. Off. ..... 93202095

[51] Int. Cl.[6] ..... C11D 7/18; C11D 7/24; C11D 7/32

[52] U.S. Cl. ..... 510/220; 510/375; 510/402

[58] Field of Search ..... 510/220–233, 510/367, 372, 375, 376, 377, 378, 402; 106/14.43; 252/295

[56] References Cited

U.S. PATENT DOCUMENTS

| | | | |
|---|---|---|---|
| 2,618,608 | 11/1952 | Schaeffer | 252/137 |
| 4,179,394 | 12/1979 | Dillenburg et al. | 510/375 |
| 4,196,093 | 4/1980 | Clarke et al. | 510/375 |
| 4,620,936 | 11/1986 | Kielman et al. | 252/99 |
| 4,820,440 | 4/1989 | Hemm et al. | 510/220 |
| 4,919,834 | 4/1990 | Chen et al. | 252/90 |
| 5,089,162 | 2/1992 | Rapisarda et al. | 252/102 |
| 5,599,781 | 2/1997 | Haeggberg et al. | 510/220 |

FOREIGN PATENT DOCUMENTS

| | | | |
|---|---|---|---|
| 41 21 307 | 1/1993 | Germany | C11D 3/37 |
| WO 93/00419 | 1/1993 | WIPO | C11D 17/00 |

*Primary Examiner*—Margaret Einsmann
*Attorney, Agent, or Firm*—Jacobus C. Rasser; Kim W. Zerby; Pankaj M. Khosla

[57] ABSTRACT

The present invention relates to a machine dishwashing composition comprising from 1% to 80% by weight of detergent builder compound oxygen-releasing bleaching agent from 0.05% to 2.5% by weight, preferably 0.1% to 1% by weight of paraffin oil, nitrogen-containing corrosion inhibitor compound Most preferably the oxygen-releasing bleaching agent is incorporated such that the level of available oxygen measured according to the method herein is from 0.3 to 1.7, preferably 0.5 to 1.2

5 Claims, 1 Drawing Sheet

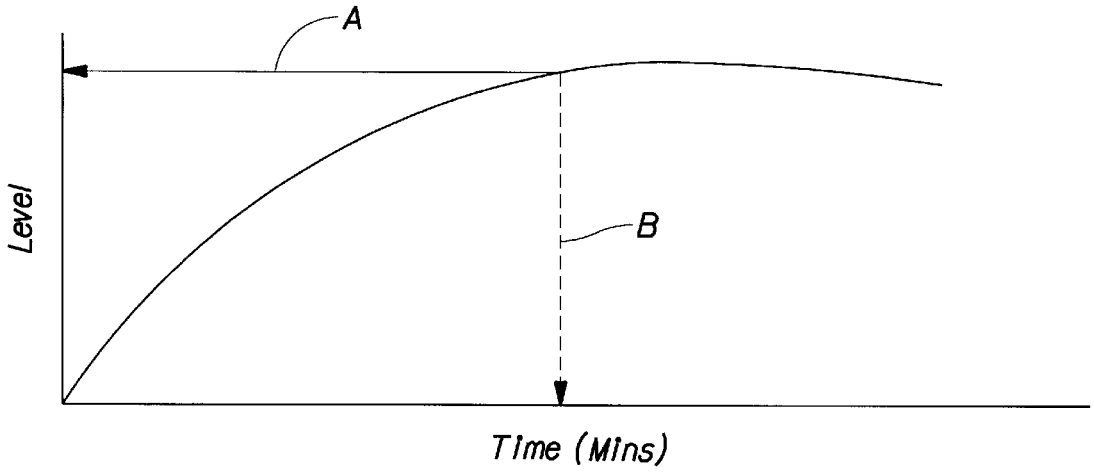
A
B
Level
Time (Mins)

MACHINE DISHWASHING COMPOSITION CONTAINING OXYGEN BLEACH AND PARAFFIN OIL AND NITROGEN COMPOUND SILVER TARNISHING INHIBITORS

TECHNICAL FIELD

The present invention relates to machine dishwashing detergent compositions exhibiting superior anti silver-tarnishing properties.

BACKGROUND OF THE INVENTION

Detergent compositions designed for use in automatic dishwasher machines are well known, and a consistent effort has been made by detergent manufacturers to improve the cleaning and/or rinsing efficiency of said composition on dishes and glassware, as reflected by numerous patent publications.

The present invention is concerned with silverware washed in automatic dishwashers, and in particular with the silver-tarnishing problem encountered with current detergent compositions for use in said automatic dishwashers, such as "compact" granular products, and being based on oxygen-bleaching species.

It has been found that the compositions of the present invention can provide excellent anti-silver tarnishing properties, as well as optimal cleaning/rinsing performance on dishes and glassware; The present compositions are based on oxygen-bleaching species, and preferably are in a compact form. The optimum anti-silver tarnishing as well as cleaning/rinsing performance is achieved through the combined use of paraffin oil and defined nitrogen-containing corrosion inhibitor compounds, as well as preferably the control of oxygen-bleaching power.

EPA 150 387 discloses chlorine-bleach-based machine dishwashing compositions containing a paraffin oil as suds suppressor; EPA 186 088 discloses machine dishwashing compositions based on carbonates and silicates, containing paraffin oils as dust binders, and water-soluble phosphonates at levels of 0.5 to 3%.

SUMMARY OF THE INVENTION

A machine dishwashing composition comprising from 1% to 80% by weight of detergent builder compound oxygen-releasing bleaching agent.

from 0.005% to 2.5% by weight, preferably 0.1% to 0.6% by weight of paraffin oil.

nitrogen-containing corrosion inhibitor compound.

In a highly preferred execution of the invention the oxygen-releasing bleaching agent is incorporated such that the level of available oxygen measured according to the method herein is from 0.3 to 1.7, preferably 0.5 to 1.2

BRIEF DESCRIPTION OF THE DRAWINGS

The FIGURE represents a graph of available oxygen level versus time.

DETAILED DESCRIPTION OF THE INVENTION

The present compositions contain as essential components detergent builder compound, oxygen-releasing bleaching species, the level of available oxygen most preferably being controlled, paraffin oil, and nitrogen-containing corrosion inhibitor compound.

Builder

The first essential component of the machine dishwashing (or rinsing) detergent composition of the present invention is detergent builder compound present at a level of from 1% to 80% by weight, preferably from 10% to 70% by weight, most preferably from 20% to 60% weight of the composition.

Suitable detergent builder compound is largely or wholly water-soluble, and can, for example, be selected from monomeric polycarboxylates, or their acid forms homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A^- \rightleftharpoons HA$$

where A is the fully ionized carboxylate anion of the builder salt.

The equilibrium constant for dilute solutions is therefore given by the expression $$K_1 = \frac{[HA]}{[H^+]\quad[A^-]}$$

and $pK_1 = \log_{10} K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

The carboxylate or polycarboxylate builder can be monomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae

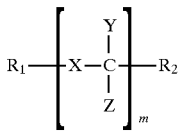

(a)

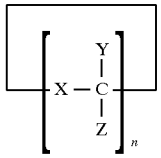

(b)

or

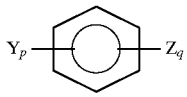

(c)

wherein $R_1$ represents H,$C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H, $C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

Water-soluble detergent builders include, but are not limited to, the alkali metal, ammonium and alkanolammonium salts of polyphosphates (exemplified by the tripolyphosphates, pyrophosphates, and glassy polymeric meta-phosphates), phytic acid, silicates, carbonates (including bicarbonates and sesquicarbonates), and sulfates. Borate builders, as well as builders containing borate-forming materials that can produce borate under detergent storage or wash conditions can also be used but are not preferred at wash conditions less that about 50° C., especially less than about 40° C.

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$: $Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$: $Na_2O$ ratio of 2.0 is the most preferred silicate.

Silicates are preferably present in the machine dishwashing detergent compositions at the invention at a level of from 5% to 50% by weight of the composition, more preferably from 10% to 40% by weight.

Whilst water-soluble detergent builders are essential components of the detergent compositions of the invention the compositions may also include less water soluble builders although preferably their levels of incorporation are minimized. Examples of such less water soluble builders include the crystalline layered silicates and the largely water insoluble sodium aluminosilicates. Crystalline layered sodium silicates have the general formula $$NaMSi_xO_{x+1.y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. More preferably M is sodium and y is 0 and preferred examples of this formula comprise the α, β, γ and δ forms of $Na_2Si_2O_5$. These materials are available from Hoechst AG FRG as respectively NaSKS-5, NaSKS-7, NaSKS-11 and NaSKS-6. The most preferred material is δ-$Na_2Si_2O_5$, NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof. The primary requirement is that the material should contain at least on functional acidic group of which the pKa should be less than 9, providing a capability for at least partial neutralisation of the hydroxyl ions released by the crystalline layered silicate.

The incorporation in the particulate of other ingredients additional to the crystalline layered silicate and ionisable water soluble compound can be advantageous particularly in the processing of the particulate and also in enhancing the stability of detergent compositions in which the particulates are included. In particular, certain types of agglomerates may require the addition of one or more binder agents in order to assist in binding the silicate and ionisable water soluble material so as to produce particulates with acceptable physical characteristics.

The crystalline layered sodium silicate containing particulates can take a variety of physical forms such as extrudates, marumes, agglomerates, flakes or compacted granules. A preferred process for preparing compacted granules comprising crystalline layered silicate and a solid, water-soluble ionisable material has been disclosed in the commonly assigned British Application No. 9108639.7 filed on 23 Apr. 1991.

Suitable aluminosilicate zeolites have the unit cell formula $Na_z[(AlO_2)_z(SiO_2)y]. XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [4 grains/gallon/minute/(gram/gallon)], based on calcium ion hardness.

Optimum aluminosilicates for builder purpose exhibit a calcium ion exchange rate of at least 260 mg equivalent of $CaCO_3$/liter/minute/(gram/liter) [4 grains/gallon/minute/(gram/gallon)].

The aluminosilicate ion exchange materials can be naturally occurring materials, but are preferably synthetically derived. A method for producing aluminosilicate ion exchange materials is discussed in U.S. Pat. No. 3,985,669. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276\ H_2O$ has the formula $Na_6[(AlO_2)_6(SiO_2)_6]\ 7.5\ H_2O$).

The builder component herein may also contain carbonate species, such as alkalimetal carbonates and bicarbonates, preferably at levels inferior to 9%, most preferably inferior to 5%, by weight of the total composition, although higher levels can also be used.

Oxygen-releasing bleaching agent

The second essential feature of the invention is oxygen bleaching agent selected from oxygen-releasing agents such as inorganic perhydrate salts, peroxyacid bleach precursors, organic peroxyacids and mixtures thereof.

It has been found that, for optimal anti-silver tarnishing performance, the level of available oxygen in the present compositions should preferably be carefully controlled; the level of available oxygen should therefore be in the range 0.3 to 1.7, preferably 0.5 to 1.2 measured according to the method described hereunder.

Preferably, the rate of release of available oxygen is also controlled; the rate of release of available oxygen from the compositions herein should be such that, when using the method described hereinafter, the available oxygen is not completely released from the composition until after 3.5 minutes.

As will become apparent in the following, the control of available oxygen release rate can be achieved either by selecting appropriate bleaching species which dissolve relatively slowly in water, or by applying certain processing techniques to otherwise fast dissolving species.

The rate of release can also be measured according to the method now described:

Method for Measuring Level of Total Available Oxygen (AvO) and Rate of Release, in a Machine Dishwashing Detergent Composition Method 1. A beaker of water (typically 2 L) is placed on a stirrer Hotplate, and the stirrer speed is selected to ensure that the product is evenly dispersed through the solution.
2. The detergent composition (typically 8 g of product which has been sampled down from a bulk supply using a Pascal sampler), is added and simultaneously a stop clock is started.
3. The temperature control should be adjusted so as to maintain a constant temperature of 20° C. throughout the experiment.
4. Samples are taken from the solution at 2 minute time intervals for 20 mins, starting after 1 minute, and are titrated by the "titration procedure" described below to determine the level of available oxygen at each point.

Titration Procedure

1. An aliquot from detergent solution (above) and 2 ml sulphuric acid are added into a stirred beaker
2. Approximately 0.2 g ammonium molybdate catalyst (tetra hydrate form) are added
3. 3 mls of 10% sodium iodide solution are added
4. Titration with sodium thiosulphate is conducted until the end point. The end point can be seen using either of two procedures. First procedure consists simply in seeing the yellow iodine colour fading to clear. The second and preferred procedure consists of adding soluble starch when the yellow colour is becoming faint, turning the solution blue. More titre is added until the end point is reached (blue starch complex is decolourised).

The level AvO for the sample at each time interval corresponds to the amount of titre according to the following equation $$AvO = \frac{Vol\ s_2o_3\ (\text{ml})}{1} \times \text{Molarity} \times \frac{1}{2} \times \frac{16}{1} \times \frac{1}{\text{sample mass (g)}}$$

AvO level is plotted versus time and is represented in the FIGURE where A represents total AvO in the product and B represents the time to reach maximum AvO level indicating the RATE of AvO release.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

It has also been found that the selection of coarse grade particles for the inorganic perhydrate salts provides a better control of available oxygen release. Accordingly, the median particle size of perhydrate salt particles herein should be in the range 400 to 900 microns, preferably 600 to 800 microns.

Sodium perborate, which is the most preferred perhydrate for inclusion in the machine dishwashing detergent compositions in accordance with the invention, can be in the form of the monohydrate of nominal formula $NaBO_2H_2O_2$ or the tetrahydrate $NaBO_2H_2O_2.3H_2O$.

The tetrahydrate species is especially preferred because of its slow disolution and therefore a better controlled release of available oxygen.

Sodium percarbonate, which is another preferred perhydrate for inclusion in detergent compositions in accordance with the invention, is an addition compound having a formula corresponding to $2Na_2CO_3.3H_2O_2$, and is available commercially as a crystalline solid. The percarbonate is most preferably incorporated into such compositions in coated form. The most preferred coating material comprises mixed salt of an alkali metal sulphate and carbonate. Such coatings together with coating processes have previously been described in GB-1,466,799, granted to Interox on 9th March 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is form 0.1 to 3, preferably n is from 0.3 to 1.0 and most preferably n is from 0.2 to 0.5.

Another suitable coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. Other suitable coating materials include the alkali and alkaline earth metal sulphates and carbonates.

Potassium peroxymonopersulfate is another inorganic perhydrate salt of particular usefulness in the machine dishwashing detergent compositions.

The level of inorganic perhydrate salt is typically from 2% to 15%, more preferably from 3.5% to 10% by weight of the total composition.

Peroxyacid bleach precursors are preferably used in combination with the above perhydrate salts. The bleach precursors useful herein contain one or more N- or O-acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864798, 1147871 and 2143231 and imides such as are disclosed in GB-A-855735 & 1246338.

Particularly preferred precursor compounds are the N,N,$N^1$,$N^1$ tetra acetylated compounds of formula

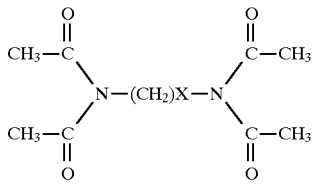

wherein x can be O or an integer between 1 & 6.

Examples include tetra acetyl methylene diamine (TAMD) in which x=l, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Another preferred class of peroxyacid bleach activator compounds are the amide substituted compounds of the following general formulae:

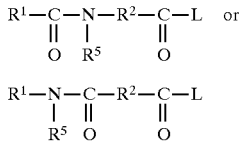

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Other peroxyacid bleach precursor compounds include sodium nonanoyloxy benzene sulfonate, sodium trimethyl hexanoyloxy benzene sulfonate, sodium acetoxy benzene sulfonate and sodium benzoyloxy benzene sulfonate as disclosed in, for example, EP-A-0341947.

The peroxyacid bleach precursors are normally incorporated at levels up to 7% by weight of active material, more preferably from 1% to 5% by weight of active material, of the total composition.

The bleaching species herein may also contain organic peroxyacids of which a particularly preferred class are the amide substituted peroxyacids of general formula:

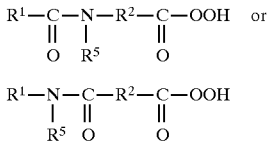

where $R^1$, $R^2$ and $R^5$ are as defined previously for the corresponding amide substituted peroxyacid bleach activator compounds.

Other organic peroxyacids include diperoxy dodecanedioic acid, diperoxy tetra decanedioic acid, diperoxyhexadecanedioic acid, mono- and diperazelaic acid, mono- and diperbrassylic acid, monoperoxy phtalic acid, perbenzoic acid, and their salts as disclosed in, for example, EP-A-0341947.

The peroxyacids can be used at levels up to 7% by weight, more preferably from 1% to 5% by weight of the composition.

Chlorine bleaches include the alkali metal hypochlorites and chlorinated cyanuric acid salts. The use of chlorine bleaches in the composition of the invention is preferably minimized, and more preferably the present compositions contain no chlorine bleach.

The paraffin oil

The present compositions must contain from 0.0005% to 2.5%, preferably from 0.1% to 1% by weight of the total composition of a paraffin oil typcially a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Nitrogen-containing corrosion inhibitor compound.

The detergent compositions of the invention contain as an essential component nitrogen-containing corrosion inhibitor compound. By nitrogen-containing corrosion inhibitor compound it is meant a compound which contains at least one nitrogen atom, and which compound acts such as to prevent the corrosion of metal, particularly silver when incoporated in detergent composition in combination with paraffin oil at the levels as defined herein, and any mixture of such compounds, wherein said nitrogen-containing corrosion inhibitor compound is not benzotriazole compound, as defined herein, and is not a heavy metal ion sequestant, as defined herein.

The nitrogen-containing corrosion inhibitor compound may be such that the nitrogen is trivalent, and hence has an available lone pair of electrons, hereinafter such compounds are referred to as nitrogen base corrosion inhibitor compound. Alternatively, the nitrogen may be tetravalent as in an ammonium corrosion inhibitor compound, as hereinafter defined.

Suitable nitrogen base corrosion inhibitor compounds include imidazole and derivatives thereof such as benzimidazole, 2-heptadecyl imidazole and those imidazole derivatives described in Czech Patent No. 139, 279 and British Patent GB-A-1,137,741, which also discloses a method for making imidazole compounds.

Also suitable as nitrogen base corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen base corrosion inhibitor compounds include 2-mercaptobenzothiazole, thionalide, morpholine, melamine, distearylamine, stearoyl stearamide, cyanuric acid, aminotriazole, aminotetrazole and indazole.

Ammonium corrosion inhibitor compound is defined herein to mean the ammonium halides, and derivatives thereof, wherein said derivatives are obtained by substitution of one or more of the H atoms of the ammonium moiety by an alkyl group, particularly $C_1$–$C_{20}$ alkyl. A particularly preferred derivative is ditallow dimethyl ammonium chloride.

Nitrogen-base corrosion inhibitor compound may be incorporated in the compositions of the invention at a level of from 0.005% to 3%, preferably from 0.02% to 1%, most preferably from 0.05% to 0.5% by weight of the composition.

Ammonium corrosion inhibitor compound may be incorporated in the compositions of the invention at a level of from 0.1% to 15%, preferably 1% to 10%, most preferably from 2% to 8% by weight of the composition.

Optional corrosion inhibitors.

The compositions of the invention may also contain optional corrosion inhibitor compounds at a level typically of from 0.01% to 3% by weight of the composition. Suitable compounds include mercaptans and diols, especially mercaptans with 4 to 20 carbon atoms including lauryl mercaptan, thiophenol, thionapthol, thionalide and thioanthranol.

Also suitable are the $C_{12}$–$C_{20}$ fatty acids, or their salts, especially aluminium tristearate. The $C_{12}$–$C_{20}$ hydroxy fatty acids, or their salts, are also suitable.

Phosphonated octa-decane and other anti-oxidants such as betahydroxytoluene (BHT) are also suitable.

Benzotriazole compound

The detergent compositions of the invention may be formulated to contain as a non-essential component benzotriazole compound at a level of from 0.005% to 2%, preferably from 0.02% to 1% and most preferably from 0.05% to 0.5% of benzotriazole compound. By benzotriazole compound it is meant a compound of formula

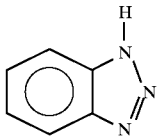

, which is benzotriazole, and any derivatives thereof.

Derivatives of benzotriazole include those where the available substitution sites of the aromatic ring are wholly or partially substituted. Substituents can include, for example, straight or branched chain alkyl groups containing, for example, from one to twenty carbon atoms in the alkyl chain. Other substituents can include —OH, —SH, phenyl or halogen groups. Other derivatives include bis-benzotriazoles. British Patent, GB-A-1,065,995 describes suitable substituted benzotriazoles of formula

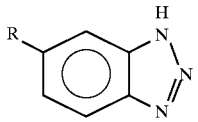

where R is a straight or branched chain alkyl group containing from two to twenty atoms, and a process for making such compounds. British Patent, GB-A-1,226,100 describes compositions containing 4,5,6,7-tetrahydrobenzotriazole compounds, which are also suitable for inclusion in the compositions of the invention.

British Patent GB-A-1, 180, 437 describes suitable bis-benzotriazoles having the formula

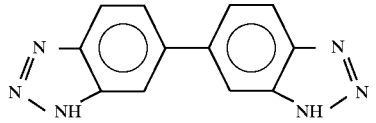

and

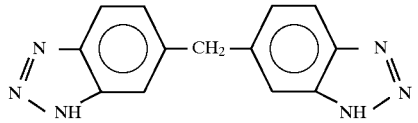

and

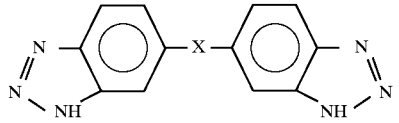

wherein X represents a straight-chain alkylene group containing from one to six carbon atoms in the chain, being substituted with one or two alkyl groups containing from one to four carbon atoms where the alkylene group contains only one carbon atom, or being substituted with one or more alkyl groups containing from one to four carbon atoms where the alkylene group contains two or more carbon atoms, or being unsubstituted where the alkylene group contains two or more carbon atoms; a 1:1-cycloalkyl residue containing at least five carbon atoms; a carbonyl group; a sulphurlyl group, an oxygen atom; or a sulphur atom.

Heavy metal ion sequestrant

The detergent compositions of the invention may be formulated to contain as a non-essential component heavy metal ion sequestrant, incorporated at a level of from 0.005% to 3%, preferably 0.05 to 1%, most preferably 0.07% to 0.4%, by weight of the total composition.

Suitable heavy metal ion sequestrant for use herein include organic phosphonates, such as amino alkylene poly (alkylene phosphonate), alkali metal ethane 1-hydroxy disphosphonates, nitrilo trimethylene phosphonates.

Preferred among above species are diethylene triamine penta (methylene phosphonate), hexamethylene diamine tetra (methylene phosphonate) and hydroxy-ethylene 1,1 diphosphonate.

The phosphonate compounds may be present either in their acid form or as a complex of either an alkali or alkaline metal ion, the molar ratio of said metal ion to said phosphonate compound being at least 1:1. Such complexes are described in U.S. Pat. No. 4,259,200. Preferably, the organic phosphonate compounds are in the form of their magnesium salt.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid or the water soluble alkali metal salts thereof. Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2EDDS$ and $Na_3EDDS$. Examples of such preferred magnesium complexes of EDDS include MgEDDS and $Mg_2EDDS$. The magnesium complexes are the most preferred for inclusion in compositions in accordance with the invention.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

The heavy metal ion sequestrant herein can consist of a mixture of the above described species.

Optional Ingredients

In addition to the essential ingredients described hereinabove, the compositions of the invention may comprise additional ingredients, which are often quite desirable ones.

A highly preferred component of the machine dishwashing compositions of the invention is a surfactant system comprising surfactant selected from anionic, cationic, nonionic ampholytic and zwitterionic surfactants and mixtures thereof. The surfactant system is present at a level of from 0.5% to 30% by weight, more preferably 1% to 25% by weight, most preferably from 2% to 20% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given in EP-A-0414 549.

Sulphonate and sulphate surfactants are useful herein. Sulphonates include alkyl benzene sulphonates having from 5 to 15 carbon atoms in the alkyl radical, and alpha-sulphonated methyl fatty acid testers in which the fatty acid is derived from a $C_6$–C18 fatty source. Preferred sulphate surfactants are alkyl sulphates having from 6 to 16, preferably 6 to 10 carbon atoms in the alkyl radical.

Useful surfactant system comprises a mixture of two alkyl sulphate materials whose respective mean chain lengths differ from each other. The cation in each instance is again an alkali metal, preferably sodium. The alkyl sulfate salts may be derived from natural or synthetic hydrocarbon sources.

The $C_6$–$C_{16}$ alkyl ethoxysulfate salt comprises a primary alkyl ethoxysulfate which is derived from the condensation product of a $C_6$–$C_{16}$ alcohol condensed with an average of from one to seven ethylene oxide groups, per mole.

Preferred are the $C_6$–$C_{10}$ alkyl ethoxysulfate salts with an average of from one to five ethoxy groups per mole.

Other anionic surfactants suitable for the purposes of the invention are the alkali metal sarcosinates of formula $$R—CON\ (R^1)\ CH_2\ COOM$$

wherein R is a $C_5$–$C_{17}$ linear or branched alkyl or alkenyl group, $R^1$ is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

Another class of anionic surfactants useful herein are the alkyl ester sulfonate surfactants which include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactants have the structural formula:

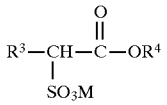

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$is methyl, ethyl or isopropyl. Especially preferred are the methyl ester sulfonates wherein $R^3$ is $C_{10}$–$C_{16}$ alkyl.

One class of nonionic surfactants useful in the present invention comprises the water soluble ethoxylated $C_6$–$C_{16}$ fatty alcohols and $C_6$–$C_{16}$ mixed ethoxylated/propoxylated fatty alcohols and mixtures thereof. Preferably the ethoxylated fatty alcohols are the $C_{10}$–$C_{16}$ ethoxylated fatty alcohols with a degree of ethoxylation of from 3 to 50, most preferably these are the $C_{12}$–$C_{16}$ ethoxylated fatty alcohols with a degree of ethoxylation from 3 to 40. Preferably the mixed ethoxylated/propoxylated fatty alcohols have an alkyl chain length of from 10 to 16 carbon atoms, a degree of ethoxylation of from 3 to 30 and a degree of propoxylation of from 1 to 10.

Thus $C_6$–$C_{16}$ alcohol itself can be obtained from natural or synthetic sources. Thus, C6–C16 alcohols, derived from natural fats, or Ziegler olefin build-up, or OXO synthesis can form suitable sources for the alkyl group. Examples of synthetically derived materials include Dobanol 25 (RTM) sold by Shell Chemicals (UK) Ltd which is a blend of $C_{12}$–$C_{15}$ alcohols, Ethyl 24 sold by the Ethyl Corporation, a blend of $C_{12}$–$C_{15}$ alcohols, Ethyl 24 sold by the Ethyl Corporation, a blend of $C_{13}$–$C_{15}$ alcoholss in the ratio 67% $C_{13}$, 33% $C_{15}$ sold under the trade name Lutensol by BASF GmbH and Synperonic (RTM) by ICI Ltd., and Lial 125 sold by Liquichimica Italiana. Examples of naturally occuring materials from which the alcohols can be derived are coconut oil and palm kernel oil and the corresponding fatty acids.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 6 to 16 carbon atoms preferably from 6 to 14 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Another preferred nonionic surfactant is a polyhydroxy fatty acid amide surfactant compound having the structural formula:

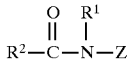

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (ie., methyl); and $R^2$ is a $C_5$–$C_{15}$ hydrocarbyl, preferably straight chain $C_5$–$C_{13}$ alkyl or alkenyl, more preferably straight chain $C_5$–$C_{11}$ alkyl or alkenyl, most preferably straight chain $C_5$–$C_9$ alkyl or alkenyl, or mixture thereof: and Z is a polyhydroxyhydrocarbyl having linear hydrocarbyl chain with at least 3 hydroxyls directly connected to the chain, or an alkoxlylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, or tallowamide.

Z can be 1-deoxyglucityl, 2-deoxyfrucittyl, 1-deoxymaltityl, 1-deoxylactityl, 1-deoxygalactityl or 1-deoxymannityl, or 1-deoxymalto-triotityl. Preferred compounds are N-methyl N-1deoxyglucityl $C_{14}$–$C_{18}$ fatty acid amides.

A further class of surfactants are the semi-polar surfactants such as amine oxides. Suitable amine oxides are selected from mono $C_6$–$C_{20}$, preferably $C_6$–$C_{10}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Another optional ingredient useful in detergent compositions is one or more enzymes.

Preferred enzymatic materials include amylases, neutral and alkaline proteases, lipases, and esterases conventionally incorporated into detergent compositions. Suitable enzymes are discussed in U.S. Pat. Nos. 3,519,570 and 3,533,139.

Preferred commercially available protease enzymes include those sold under the tradenames Alcalase and Savinase by Novo Industries A/S (Denmark) and Maxatase by International Bio-Synthetics, Inc. (The Netherlands). Protease enzyme may be incorporated into the compositions in accordance with the invention at a level of from 0.005% to 2% active enzyme by weight of the composition.

Preferred amylases include, for example, -amylases obtained from a special strain of B licheniforms, described in more detail in GB 1,269,839 (Novo). Preferred commercially available amylases include for example, Rapidase, sold by International Bio-Synthetics Inc, and Termamyl, sold by Novo Industries A/S. The invention at a level of from 0.001% to 2% active enzyme by weight of the composition.

A preferred lipase is derived from *Pseudomonas pseudoalcaligenes,* which is described in Granted European Patent, EP-B-0218272.

Another optional component of the machine dishwashing or rinsing detergent compositions of the invention is a silicone suds controlling agent present at levels of from 0.01% to 5% by weight, more preferably from 0.05% to 3% by weight, most preferably from 0.05% to 1% by weight of the composition.

Another preferred lipase herein is obtained by cloning the gene from *Humicola lanuginosa* and expressing the gene is *Aspergillus oryza,* as host, as described in European Patent Application, EP-A-0258068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Another optional ingredient is a lime soap dispersant compound, present at a level of from 0.05% to 40% by weight, more preferably 0.1% to 20% by weight, most preferably from 0.25% to 10% by weight of the compositions.

A lime soap dispersant is a material that prevents the precipitation of alkali metal, ammonium or amine salts of fatty acids by calcium or magnesium ions. Preferred lime soap dispersants include C13–15 ethoxylated alcohol sulphates with an average degree of ethoxylation of 3.

By silicone suds controlling agent it is meant any suds controlling agent which comprises a silicone antifoam compound. Thus silicone suds controlling agents include agents containing silicone-silica mixtures and particulates in which the silicone, or silicone-silica mixture, is incorporated in a water-soluble or water-dispersible carrier material. Alternatively, the silicone suds controlling agents may comprise silicone, or silicone-silica mixutes dissolved or dispersed in a liquid carrier and applied by spraying on to one or more of the other components of the detergent composition. In industrial practice the term "silicone" has become a generic term which encompasses a variety of relatively high molecular weight polymers containing siloxane units and hydrocarbyl group of various types.

Generally, the silicone antifoam compounds can be described as siloxanes having the general structure:

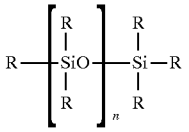

where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from $5\times10^{-5}$ $m^2/s$ to 0.1 $m^2/s$ i.e. a value of n in the range 40 to 1500. These are preferred because of their ready availability and their relatively low cost.

A preferred type of silicone suds controlling agent useful in the compositions herein comprises a mixture of an alkylated siloxane of the type hereinabove disclosed and solid silica.

The solid silica can be a fumed silica, a precipitated silica or a silica made by the gelformation technique. The silica particles suitable have an average particle size of from 0.1 to 50 micrometers, preferably from 1 to 20 micrometers and a surface area of at least 50 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. The suds controlling agents for inclusion in the detergent compositions in accordance with the invention suitably contain an amount of silica such that the weight ratio of silica to silicone lies in the range from 1:100 to 3:10, preferably from 1:50 to 1:7.

A preferred silicone suds controlling agent is represented by a hydrophobic silanated (most preferably trimethylsilanated)silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

Another preferred silicone suds controlling agent is disclosed in Bartollota et Al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

A highly preferred silicone suds controlling agent is a particulate of the type disclosed in EP-A-0210731 comprising a silicone antifoam and an organic material having a melting point in the range 50° to 85° C., wherein the organic material comprises a monoester of glycerol and a fatty acid having a carbon chain containing from 12 to 20 carbon atoms. EP-A-0210721 discloses similar particulate suds controlling agents wherein the organic material however, is a fatty acid or alcohol having a carbon chain containing from 12 to 20 carbon atoms, or a mixture thereof, with a melting point of from 45° C. to 80° C.

Other highly preferred silicone suds controlling agents are described in copending European Application 91870007.1 in the name of the Procter and Gamble Company which discloses granular suds controlling agents comprising a silicone antifoam compound, a carrier material an organic coating material and glycerol at a weight ratio of glycerol: silicone antifoam compound of 1:2 to 3:1. Copending European Application 91201342.0 also discloses highly preferred granular suds controlling agents comprising a silicone antifoam compound, a carrier material, an organic coating material and crystalline or amorphous aluminosilicate at a weight ratio of aluminosilicate: silicone antifoam compound of 1:3 to 3:1. Ther preferred carrier material in both of the above described highly preferred granular suds controlling agents is starch.

The preferred methods of incorporation of the silicone suds controlling agents comprise either application of the silicone suds controlling agent in liquid form by spray-on to one or more of the major components of the composition or alternatively the formation of the silicone suds controlling agents into separate particulates that can then be mixed with the other solid components of the composition. The incorporation of the suds controlling agents as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds controlling particulates are disclosed in the previously mentioned Bartolotta et al U.S. Pat. No. 3,933,672.

Other optional ingredients suitable for inclusion in the compositions of the invention include antiredeposition, and soil-suspension agents, perfumes, colours and filler salts, with sodium sulfate being a preferred filler salt.

Form of the compositions

The machine dishwashing compositions of the invention can be formulated in any desirable form such as powders, granulates, pastes, liquids, gels and tablets, granular forms being preferred.

The bulk density of the granular detergent compositions in accordance with the present invention is typically of at least 650 g/liter, more usually at least 700 g/liter and more preferably from 800 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrial cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

The particle size of the components of granular compositions in accordance with the invention should preferably be such that no more that 5% of particles are greater than 1.4 mm in diameter and not more than 5% of particles are less than 0.15 mm in diameter.

Generally, if the machine dishwashing or rinsing detergent compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise. In many cases it is desirable to include a viscosity control agent or a thixotropic agent to provide a suitable liquid product form. Suitable thixotropic or viscosity control agents include methyl cellulose, carboxymethylcellulose, starch, polyvinyl, pyrrolidone, gelatin, colloidal silica, and natural or synthetic clay minerals.

Pasty compositions in accordance with the invention generally have viscosities of about 5,000 centipoise and up to several hundred million centipoise. In order to provide satisfaction pasty compositions a small amount of a solvent or solubilizing agent or of a gel-forming agent can be included. Most commonly, water is used in this context and forms the continuous phase of a concentrated dispersion. Certain nonionic surfactants at high levels form a gel in the presence of small amount of water and other solvents. Such gelled compositions also envisaged in the present invention.

pH of the compositions

The pH of a 1% solution of the present compositions is preferably from 7.5 to 12, more preferably from 9 to 11.5, most preferably from 10 to 11.

Making process for the compositions herein

A preferred making process for the compositions herein comprises pre-mixing of the paraffin oil and/or the benzotriazole compound with a dispersing agent and the resultive intimate pre-mix being sprayed onto the remainder of the composition. The dispersing agent can advantageously consist of a nonionic surfactant such as described hereinabove, which therefore serves two functions in the present composition.

A preferred dispersing agent is Plurafac LF404 sold by BASF.

An alternate route consists in spraying the intimate mixture of paraffin oil and/or the benzotriazole compound and dispersing agent onto the particles of bleaching agent, resulting in a reduction in the rate of dissolution in water of said bleaching agent and therefore providing a control over the rate of release of available oxygen. The coated particles of bleaching agent are then dry-mixed with the remainder of the composition.

In another process embodiment herein, the particles of bleaching agents are compacted before being dry-mixed with the remainder of the composition This technique slows down the dissolution rate in water, and is therefore advantageously applied to otherwise fast dissolving species like perborate monohydrate.

In this embodiment, the paraffinic oil and/or the benzotriazole compound is typically compacted along with the bleaching species, and optionally other ingredients like sodium sulphate and/or binders. The resulting particles are then dry-mixed with the remainder of the ingredients.

EXAMPLES

The following examples illustrate the present invention.

In the following detergent compositions, the abbreviated identifications have the following meanings:

| | |
|---|---|
| Citrate: | Tri-Sodium citrate dihydrate |
| Phosphate: | Sodium tripolyphosphate |
| MA/AA: | Copolymers of 1:4 maleic/acrylic acid, average molecular weight about 80,000 |
| Silicate: | Amorphous Sodium Silicate ($SiO_2$:$Na_2O$ ratio normally follows) |
| Protease: | Proteolytic enzyme sold under the trade name Savinase by Novo Industries A/S |
| Amylase: | Amylolytic enzyme sold under the trade name Termamyl by Novo Industries A/S |
| Nonionic: | $C_{13}$–$C_{15}$ mixed ethoxylated/propoxylated fatty alcohol with an average degree of ethoxylation of 3.8 and an average degree of propoxylation of 4.5 sold under the trade name Plurafac LF404 by BASF GmbH. |
| Anionic: | $C_6$–$C_{10}$ alkyl ethoxysulfate with 1–5 ethoxy groups per mole |
| Sulphate: | Anhydrous Sodium Sulphate |
| TAED: | Tetraacetyl ethylene diamine |
| DTPMP: | Diethylene triamine penta (methylene phosphonic acid) |
| EDDS: | Ethylene Diamine-N,N Disuccinic acid |

The following machine dishwashing detergents according to the invention are prepared (parts by weight):

| | Parts by weight | | | |
|---|---|---|---|---|
| Ingredients | I | II | III | IV |
| citrate | 38.0 | 35.0 | 40.0 | 35.0 |
| MA/AA | 4.0 | 6.0 | 2.0 | 4.0 |
| 2 ratio silicate (2.0 ratio) | 26.0 | 30.0 | 20.0 | 30.0 |
| AvO level | 0.8 | 0.8 | 1.0 | 1.0 |
| Perborate monohydrate(1) | 5.05 | — | — | |
| Perborate tetrahydrate | 8.0 | — | 9.0 | 9.0 |
| TAED | 2.5 | 2.2 | 3.0 | 2.2 |
| Paraffin oil(2) | 0.5 | 0.5 | 0.3 | 0.3 |

-continued

| Ingredients | Parts by weight I | II | III | IV |
|---|---|---|---|---|
| Protease | 2.0 | 2.5 | 2.2 | 2.0 |
| Amylase | 1.5 | 0.5 | 1.0 | 1.0 |
| Lipase | — | — | 2.0 | — |
| Nonionic[3] | 1.54 | 1.0 | 1.5 | 1.5 |
| Anionic | — | 3.0 | — | — |
| DTPMP | 0.1 | 0.2 | — | — |
| Benzimidazole | 0.2 | — | — | — |
| 2-mercaptobenzothiazole | — | 0.2 | — | — |
| cyanuric acid | — | — | 1.0 | — |
| Ammonium chloride | — | — | — | 5 |
| EDDS | 0.1 | — | 0.15 | — |
| Limesoap dispersant[4] | — | — | 2.5 | — |
| Suds suppressor | — | 1.0 | — | — |
| Sulphate | | balance to 100 | | |
| pH | 10.7 | 10.7 | 10.7 | 10.7 |

[1]Pre-compacted before incorporation
[2]WINOG 70 ex Wintershall
[3]Pre-mixed with the paraffin oil before incorporation
[4]Lutensol AO12 ex BASF

We claim:

1. An automatic dishwashing detergent composition comprising:

(a) from about 1% to about 80% by weight of the composition of a detergency builder compound;

(b) from about 2% to 15% of an inorganic peroxyhydrate bleaching agent;

(c) from about 0.005% to about 2.5% by weight of the composition of paraffin oil;

(d) from about 0.005% to about 3% by weight of the composition of a nitrogen containing corrosion inhibitor compound; and (e) from about 0.01% to about 3% by weight of the composition of a corrosion inhibitor selected from the group consisting of $C_4$–$C_{20}$ mercaptans, and mixtures thereof.

2. The composition as claimed in claim 1 wherein component (e) is a mercaptan selected from the group consisting of lauryl mercaptan, thiophenol, thionapthol, thionalide, thioanthranol and mixtures thereof.

3. The composition as claimed in claim 1 wherein said paraffin oil is present at a level of from about 0. 1% to about 1% by weight of the composition.

4. The composition as claimed in claim 1 wherein said paraffin oil is a predominately branched aliphatic hydrocarbon having from about 20 to about 50 carbon atoms with a ratio of cyclic to noncyclic hydrocarbons of about 32:68.

5. The composition as claimed in claim 1 wherein said nitrogen-containing corrosion inhibitor compound is imidazole or a derivative thereof.

* * * * *